US006648674B1

(12) United States Patent
Dobler

(10) Patent No.: US 6,648,674 B1
(45) Date of Patent: Nov. 18, 2003

(54) ELECTRICAL CONNECTOR

(75) Inventor: Oliver Dobler, Tschagguns (AT)

(73) Assignee: Neutrik Aktiengesellschaft (LI)

( * ) Notice: Subject to any disclaimer, the term of this patent is extended or adjusted under 35 U.S.C. 154(b) by 0 days.

(21) Appl. No.: 10/298,693

(22) Filed: Nov. 18, 2002

(51) Int. Cl.[7] ..... H01R 13/58

(52) U.S. Cl. ..... 439/460; 439/455; 439/459; 439/465; 439/578

(58) Field of Search ..... 439/460, 461, 439/465, 466, 468, 469, 578, 582, 584, 455, 459

(56) References Cited

U.S. PATENT DOCUMENTS 3,624,591 A * 11/1971 Buberniak ..... 439/462
3,958,300 A * 5/1976 Tanaka ..... 174/68.1
3,989,340 A * 11/1976 Sheldon et al. ..... 439/462
4,869,686 A * 9/1989 Michaels et al. ..... 439/455
4,940,262 A * 7/1990 Baracat et al. ..... 285/114
5,205,749 A * 4/1993 Weingartner ..... 439/335
5,599,202 A * 2/1997 Key ..... 439/459
6,036,529 A * 3/2000 Brown et al. ..... 439/445
6,171,136 B1 * 1/2001 Liu et al. ..... 439/466
6,478,607 B2 * 11/2002 Tabata ..... 439/456

* cited by examiner

*Primary Examiner*—Truc T. T. Nguyen
(74) *Attorney, Agent, or Firm*—Neal L. Slifkin; Harris Beach LLP

(57) ABSTRACT

An electrical cable connector comprises a connector box, electrical contacts (2), to which electrical conductors of a cable (5) can be connected, and a strain relief device clasping a clamp (11) that annularly surrounds cable (5) and that can be tightly pressed against cable (5) by screwing a clamp sleeve (13) on a thread (8, 17) designed at the rear end of the connector box. An angle-box part (14) is designed that consists of at least two mutually connectable shells (15, 15'), each of which extends over a portion of the envelope of the angle-box part (14), when shells (15, 15') are assembled, wherein shells (15, 15') of the angle-box part (14) comprise, in the area of their front ends, a section of an internal thread (16), and these thread sections, when shells (15, 15') of the angle-box part (14) are assembled, form an internal thread (16), which is exactly compatible with an external thread (8) in the area of the rear end of a front box part (1) retaining contacts (2), and shells (15, 15') of angle-box part (14) in the area of their rear ends comprise a section of an external thread (17) on which clamp sleeve (13) can be screwed.

10 Claims, 2 Drawing Sheets

ELECTRICAL CONNECTOR

TECHNICAL FIELD

The invention relates to an electrical cable connector (plug) with a connector box, electrical contacts, to which electrical conductors of a cable can be connected, and a strain relief device clasping a clamp that annularly surrounds the cable and that can be tightly pressed against the cable by screwing a clamp sleeve on a thread designed at the rear end of the connector box.

BACKGROUND

Cable connectors that are also called "free connectors" are mounted onto an electrical cable in order to electrically connect the cable, by means of a plug-and-socket connection, for example with an electrical device or with another cable. Such cable connectors have become known in the most varied forms. Besides the "straight connectors", in which the plugging direction, the connector box, and the cable leaving the connector all lie in one axis, there also exist "angle connectors", whose box consists of two sections, the longitudinal axes of which are mutually oriented at a right angle, wherein the cable connected to such connector leaves the connector at an angle or at right angle. Straight connectors and angle connectors are normally offered as alternatives, and depending on the available space, the electrical cable can be connected to a straight connector or to an angle connector.

Such connectors are known, for example, from DE 199 21 132 C1, U.S. Pat. Nos. 3,989,340 and 5,205,749.

Connectors that can be alternatively used as angle connectors or straight connectors are known from DE 82 28 161 U1 and DE 89 06 957 U1. The boxes of these connectors are divided into a front section and a rear section, wherein the rear section can be oriented at various angles in relation to the front section.

Furthermore, U.S. Pat. No. 4,671,598 discloses an angle connector comprising an angle-box part consisting of a front section and a rear section, whose axes run at angle to each other, wherein the rear section consists of several shells, while each of them form a portion of the compact perimeter of the angle-box part with the shells in collapsed condition. In the area of its rear end, each shell comprises a perimeter portion of an external thread, wherein these perimeter portions form a complete external thread, when the shells are in their collapsed condition.

SUMMARY

One task of the invention is to provide a cable connector of the initially described type that can be easily converted from a straight connector into an angle connector and vice versa. Another task of the invention is to provide a cable connector of the initially described type that can be converted from a straight connector into an angle connector and vice versa, while a cable is connected to it.

According to this invention, this task is resolved by a connector demonstrating the characteristics of patent claim 1. Such connector according to this invention can be converted from a straight connector into an angle connector and vice versa with a few simple operations, doing so without having to disconnect the cable from the connector that is already connected to its electrical contacts. If, for example, the connector was wired as a straight connector, the conversion into an angle connector is performed by unscrewing the clamp sleeve, shifting the clamp sleeve and the clamp back alongside the cable, putting the shells of the angle-box part on the rear-side thread of the box part, mutually connecting them, and screwing the clamp sleeve on the rear-end thread of the angle-box part.

In an advantageous design variant, the angle-box part consists of two half-shells that are screwed together by a bolt. As a principle, it is thinkable and possible too, to design the angle-box part to consist from more than two shells, for example from three shells, each of which comprising one third of the perimeter of the angle-box part. Instead of or in addition to a bolt, also other connecting elements can be designed to connect the shells; for example, this connection could be designed as a pure snap-on connection or a self-locking connection, or one or several clamping rings could be designed to surround the assembled shells on the outer side.

Further advantages and details of the invention are subsequently described using the attached drawing that represents an advantageous design variant of the invention, from which also other tasks of the invention will follow.

DETAIL DESCRIPTION

Figure 1:
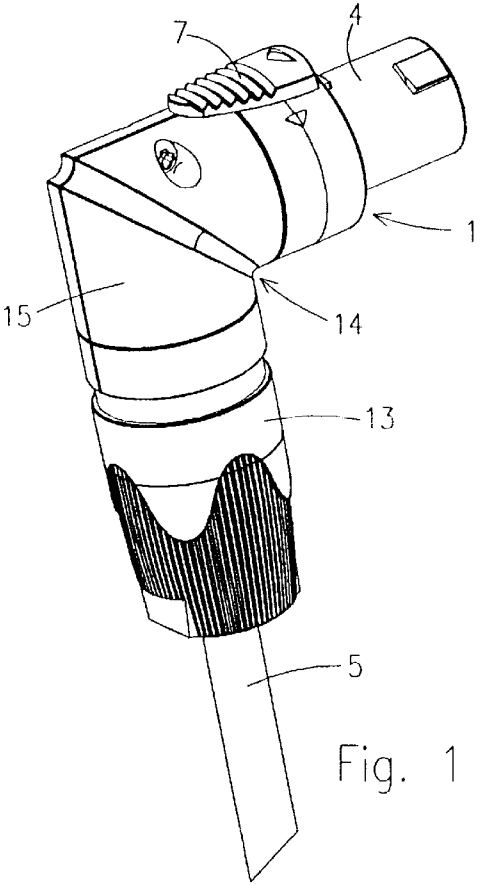
FIG. 1 shows a cable connector according to this invention in an exploded view.
Figure 2:
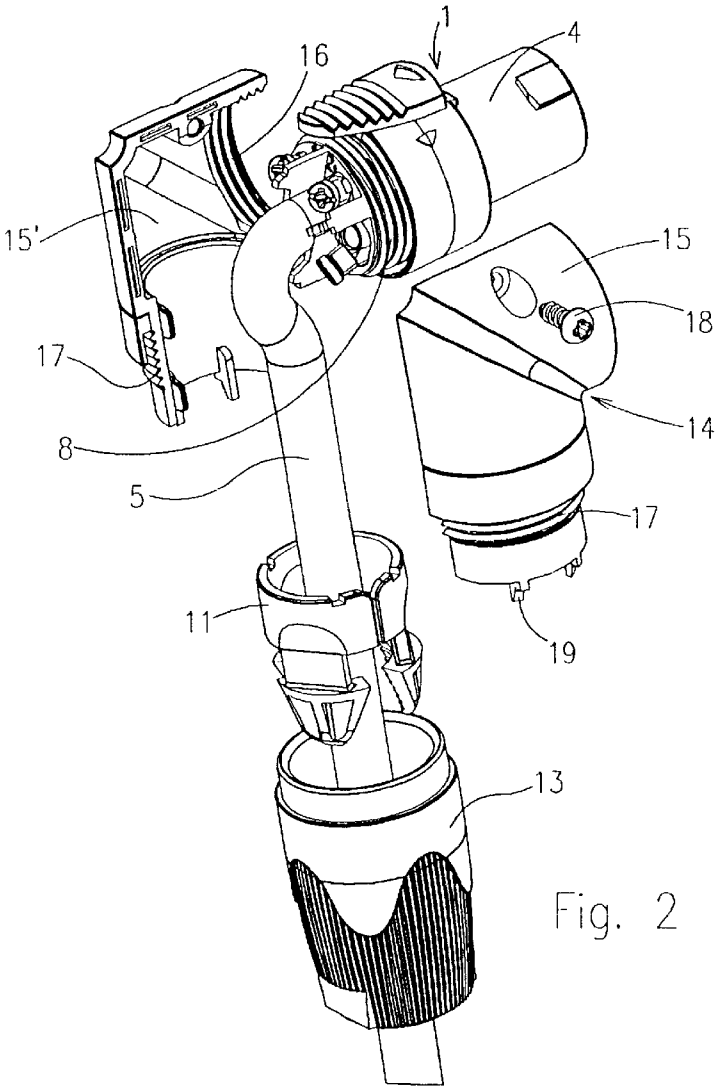
FIG. 2 shows the cable connector from FIG. 1 with an unscrewed clamp sleeve and removed shells of the angle-box part.

The cable connector represented in the figures comprises a front box part 1 that contains electrical contacts 2, which means that there are electrical contacts on or in this front box part that are designed to be connected to electrical contacts of an opposite connector (socket). For example, such electrical contacts can be designed as contact pins or as contact jacks. In the shown design example of a cable connector, the front box part 1 comprises, at its front end, a central connecting extension 3 and a ring-shaped connecting extension 4 surrounding extension 3. Two electrical contacts 2 are arranged, diametrically opposite to each other, on the outer wall of connecting extension 3 and on the inner wall of the ring-shaped connecting extension 4. At the rear side of the front box part 1, electrical conductors of a cable 5 are connected to electrical elements 2, which can be ensured, for example, by screws 6 that clamp the cable. Other connection means can be also designed for this purpose such as any friction-based, form-based, or material-binding types of connections as well as crimp connections or soldered connections.

In the shown design example, the front box part 1 is designed as one single part together with the insert carrying contact elements 2, namely in the form of an injection-molded part. Instead, a two-part or multiple-part type with a separate inserted part carrying contact elements 2 could also be designed. Furthermore, as shown in the figure, the front box part 1 can also comprise a locking slider 7 for the purpose of locking and unlocking an opposite connector (socket).

Figures 3, 4, 5:
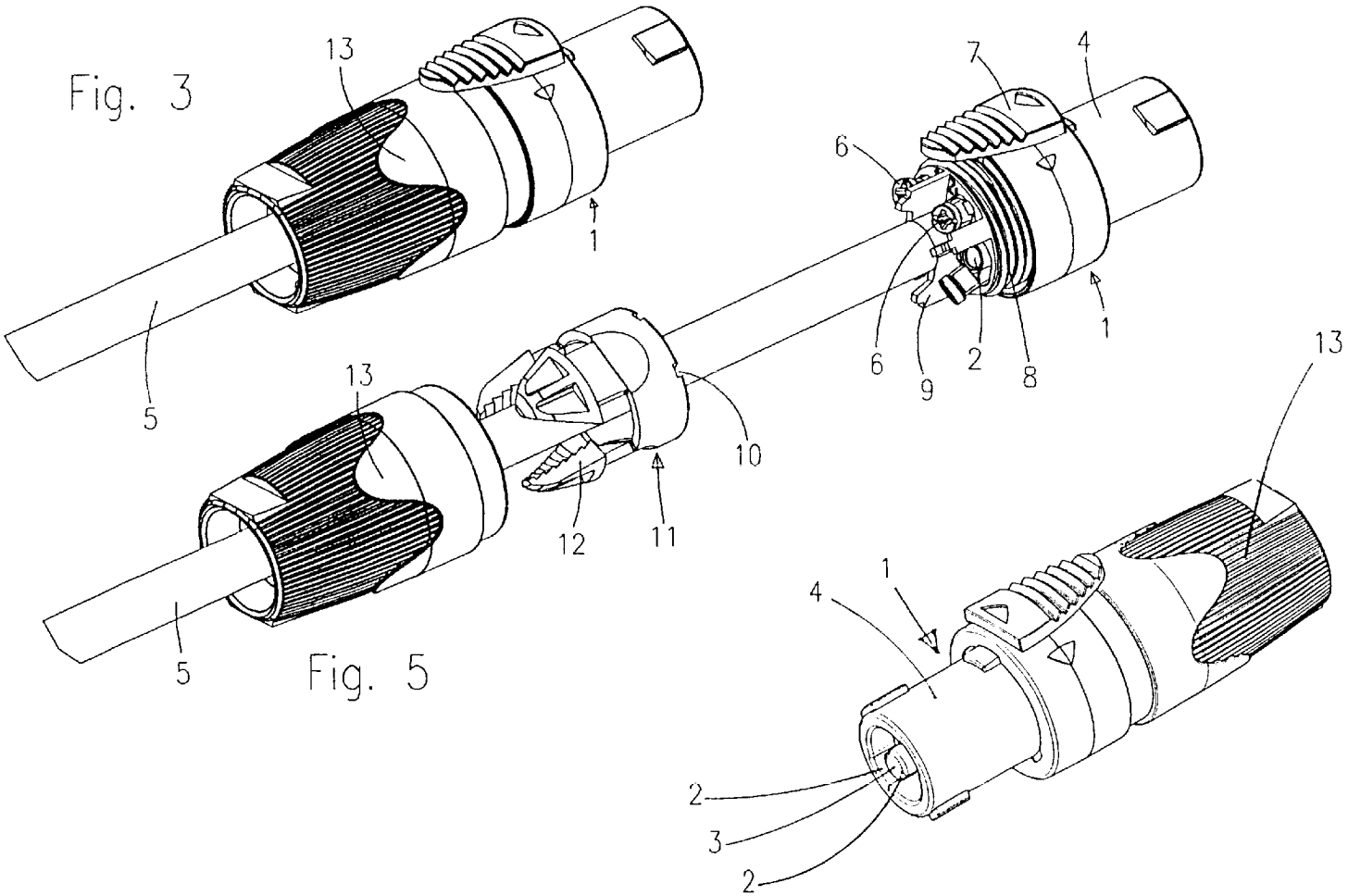
FIG. 3 shows the cable connector from FIGS. 1 and 2 with the angle-box part removed.
FIG. 4 shows the cable connector from FIG. 3 in an exploded view seen obliquely from the front.
FIG. 5 shows the cable connector from FIG. 3 with the clamp sleeve unscrewed.

An external thread 8 is arranged on the rear-side end of the front box part 1. Further arranged on the rear-side end of the front box part 1 are protruding lugs 9. When the connector is in assembled state, these lugs protrude into slots 10 of clamp 11 that surrounds cable 5, which ensures that clamp 11 cannot twist. Clamp 11 comprises tongue-shaped prolongations 12 extending backwards. A clamp sleeve 13 (being equipped with a corresponding internal thread) can be screwed on the external thread 8, which causes prolongations 12 to press against cable sheath 5 in order to clamp cable 5 and connect it firmly to the cable connector. If clamp sleeve 13 is screwed directly onto external thread 8 at the rear side of the front box part 1, a straight cable connector arises as shown in FIGS. 3 to 5.

Furthermore, the cable connector according to this invention comprises an angle-box part 14 that, in the shown design example, consists of two shells 15, 15' in the form of half-shells. Each of the two half-shells forms half of the envelope of the angle-box part 14, when the two half-shells 15, 15' are assembled. Angle-box part 14 comprises a front section and a rear section that have closed-perimeter, for example ring-shaped, cross-sections. In the shown design example, the longitudinal axes of these sections are mutually oriented at right angle. The longitudinal axis of the front section runs parallel to the longitudinal axis of the front box part 1 and the longitudinal axis of the rear section runs parallel to the longitudinal axis of cable 5 exiting from the angle-box connector. In principle, other angles between the front section and the rear section of the angle-box part 14 are also thinkable and possible, especially those within the range of 60° to 120°.

Shells 15, 15' extending over the length of angle-box part 14 comprise at their front ends a section of an internal thread 16. When shells 15, 15' are assembled, these thread sections form a complete internal thread, which is compatible with external thread 8 arranged in the area of the rear end of the front box part 1. In the area of their rear ends, shells 15, 15' comprise a section of an external thread 17, wherein—when shells 15, 15' are assembled—these thread sections form a complete external thread, on which clamp sleeve 13 can be screwed.

If cable 5 has already its conductors connected to the front box part 1, then in order to create an angle connector, the two shells 15, 15' with their partial sections of internal thread 16 can be placed on external thread 8 of the front box part 1 and screwed together by a bolt 18. When doing so, bolt 18 is inserted through a bored hole in one of the two shells 15, and is then screwed into a pocket hole bored in the other shell 15'. Bolt 18 is oriented vertically to the longitudinal axes of the two sections of the angle-box part 14 that are mutually arranged at an angle. In addition to or instead of such bolt-on connection, a snap-on or self-locking connection can also be designed between the two shells 15 and 15'. Other connecting elements between the two shells 15 and 15' are also thinkable and possible, and—as already mentioned—instead of two shells also three or more such shells can be designed, of which each forms a portion of the entire envelope of the angle-box part. Projections 19 protruding backwards are arranged on the rear ends of shells 15 and 15'. When the angle connector is assembled, these projections protrude into slots 10 of clamp 11 to secure it from twisting. By screwing clamp sleeve 13 on the external thread 17 of the angle-box part 14, cable 5 is clamped by means of clamp 11.

When assembled as an angle connector, the connector box is formed by the front box part 1 and angle-box part 14, while when assembled as a straight connector, the connector box is formed only by the front box part 1.

At least the front box part 1 and/or—if it is designed in multiple parts—its section with external thread 8 and shells 15 and 15' of the angle-box part 14 are preferably designed as injection-molded parts. The fabrication of these parts with precise mold-based dimensions ensures that the beginnings of threads 8 and 16 are always at the same place, which contributes to a proper positioning, i.e., after the sections of the internal thread 16 of the two shells 15 and 15' are placed on the external thread 8 of the front box part 1 and the two shells 15 and 15' are connected, a firm connection free from play is established between the angle-box part 14 and the front box part 1.

While the preceding description and the drawings represent the invention, it is clear to any expert that various changes can be made in the design without leaving the true spirit and domain of the invention. The domain of the invention should be defined with reference to the indicated claims together with its full range of possible equivalents.

Legend to Reference Numbers

1 Front box part
2 Contact
3 Connecting extension
4 Connecting extension
5 Cable
6 Bolt
7 Locking slider
8 External thread
9 Lug
10 Slot
11 Clamp
12 Extension
13 Clamp sleeve
14 Angle-box part
15, 15' Shells
16 Internal thread
17 External thread
18 Bolt
19 Lug

What is claimed is:

1. Electrical cable connector with a connector box, electrical contacts (2), to which electrical conductors of a cable (5) can be connected, and a stress relief device clasping a clamp (11) that annularly surrounds cable (5) and that can be tightly pressed against cable (5) by screwing a clamp sleeve (13) on a thread (8, 17) designed at the rear end of the connector box, wherein to enable the conversion of the cable connector between a straight connector and an angle connector, an angle-box part (14) is designed that comprises a front section and a rear section, whose axes run at an angle in relation to each other and which consists of at least two mutually connectable shells (15, 15'), each of which extend over a portion of the envelope of the angle-box part (14), when shells (15, 15') are assembled, wherein shells (15, 15') of the angle-box part (14) comprise, in the area of their front ends, a section of an internal thread (16), and these thread sections, when shells (15, 15') of the angle-box part (14) are assembled, form an internal thread (16), which is exactly compatible with an external thread (8) in the area of the rear end of a front box part (1) retaining contacts (2), and shells (15, 15') of angle-box part (14) in the area of their rear ends comprise a section of an external thread (17) and these thread section, when shells (15, 15') of the angle-box part (14) are assembled, form an external thread (17), and wherein to form a straight connector, clamp sleeve (13) is screwed on external thread (8) arranged on the rear end of the front box part (1) and, to form an angle connector, clamp sleeve (13) is screwed, with its internal thread (16), on the external thread (17) of the angle-box part (14) placed on external thread (8) of the front box part (1).

2. Cable connector according to claim 1, wherein the axes of the front section and the rear section of the angle-box part (14) are oriented at an angle in relation to each other.

3. Cable connector according to claim 1, wherein shells (15, 15') extend over the length of the angle-box part (14).

4. Cable connector according to claim 1, wherein shells (15, 15') are two half-shells that together form the angle-box part (14).

5. Cable connector according to claim 1, wherein projections (19) are arranged on the rear end of the front box part (1) and these projections protrude into slots (10) in clamp (11) in order to prevent clamp (11) from twisting.

6. Cable connector according to claim 1, wherein projections (19) are arranged on the rear end of the angle-box part and these projections protrude into slots (10) in clamp (11) in order to prevent clamp (11) from twisting.

7. Cable connector according to claim 1, wherein the front box part (1) and shells (15, 15') of the angle-box part (14) are formed by injection-molded parts.

8. Cable connector according to claim 2, wherein the axes of the front section and the rear section of the angle-box part together enclose an angle in a range between 60° and 120°.

9. Cable connector according to claim 4, wherein the two half-shells can be bolted together by means of a bolt (18).

10. Cable connector according to claim 9, wherein the bolt is arranged vertically to the longitudinal axes of the front section and the rear section of the angle-box part (14).

* * * * *